United States Patent [19]

Chi

[11] Patent Number: 5,074,938

[45] Date of Patent: Dec. 24, 1991

[54] LOW PRESSURE EXPONENT PROPELLANTS CONTAINING BORON

[75] Inventor: Minn-Shong Chi, New Castle, Del.

[73] Assignee: Thiokol Corporation, Ogden, Utah

[21] Appl. No.: 528,938

[22] Filed: May 25, 1990

[51] Int. Cl.[5] ..... C06B 45/02

[52] U.S. Cl. ..... 149/21; 102/285; 102/291; 102/292; 149/2; 149/19.4; 149/19.5; 149/22; 149/43; 149/44; 149/60; 149/88; 149/109.6; 149/114

[58] Field of Search ..... 149/2, 21, 22, 19.4, 149/19.5, 43, 44, 60, 88, 114, 109.6; 102/285, 291, 292

[56] References Cited

U.S. PATENT DOCUMENTS

| | | | |
|---|---|---|---|
| 25,695 | 12/1864 | Cook et al. | 149/21 |
| 2,995,431 | 8/1961 | Bice | 52/5 |
| 3,196,059 | 7/1965 | Godfrey | 149/19 |
| 3,423,256 | 1/1969 | Griffith | 149/2 |
| 3,465,675 | 9/1969 | Bronstein, Jr. | 102/23 |
| 3,924,405 | 12/1975 | Cohen et al. | 60/219 |
| 3,953,259 | 4/1976 | Sayles | 149/19.5 |
| 3,976,521 | 8/1976 | Boyd et al. | 149/5 |
| 3,986,909 | 10/1976 | Macri | 149/19.9 |
| 3,986,910 | 10/1976 | McCulloch et al. | 149/19.9 |
| 4,141,768 | 2/1979 | Lo et al. | 149/22 |
| 4,298,411 | 11/1981 | Godsey | 149/19.4 |
| 4,560,779 | 12/1985 | Guimont et al. | 549/510 |
| 4,637,847 | 1/1987 | Nieder | 149/6 |
| 4,642,147 | 2/1987 | Hyyppa | 149/19.9 |
| 4,650,617 | 3/1987 | Kristofferson et al. | 264/3.3 |
| 4,776,993 | 10/1988 | Chang et al. | 263/3.3 |
| 4,798,142 | 1/1989 | Canterberry et al. | 102/290 |
| 4,798,636 | 1/1989 | Strecker | 149/19.9 |

*Primary Examiner*—Stephen J. Lechert, Jr.

*Attorney, Agent, or Firm*—Neuman, Williams, Anderson & Olson

[57] ABSTRACT

Propellant grain consisting essentially of:

A. from about 50% to about 75% by weight of an oxidizer consisting essentially of ammonium nitrate;

B. from about 1% to about 20% by weight of a cured polymeric binder;

C. from 0% to about 30% by weight of a nitrate ester plasticizer;

D. from about 3.5% to about 8% by weight of boron in free elemental form; and

E. from 0% to about 3% by weight of aluminum metal.

The grain has a pressure exponent not exceeding about 0.30 at a combustion pressure between about 2500 and about 7000 pounds per square inch (between about 1700 and about 4800 N/cm$^2$). Also, an uncured pourable slurry having the formula stated above, except that the binder is uncured. Also, a method for forming a propellant grain having the formula stated above, comprising the steps of providing the uncured pourable slurry defined above, pouring the slurry into a casing, and curing the slurry in situ to form a cured propellant grain having a pressure exponent not exceeding about 0.30 in the pressure range defined above.

18 Claims, 4 Drawing Sheets

LOW PRESSURE EXPONENT PROPELLANTS CONTAINING BORON

The present invention relates to propellant grains, and especially to composite propellant grains for rocket motors and the like which are burned to provide propulsion force. Composite propellants contain a major quantity of an oxidizer, enough of a curable binder to provide a propellant which flows in its uncured state and forms a rubbery mass when cured, and optionally a nitrate ester plasticizer, minor amounts of energetic metals, and other ingredients.

BACKGROUND OF THE INVENTION

For propellants generally, the art has recognized that incorporation of finely divided boron, aluminum, or other metals in a propellant formulation often increases its burning rate and specific impulse. See: U.S. Pat. No. 3,196,059, issued to Godfrey on Jul. 20, 1965, column 7, starting on line 47. All the examples of Godfrey use 20% or more aluminum.

U.S. Pat. No. 2,995,431, issued to Bice on Aug. 8, 1961, teaches a composition of 2 to 6 parts (from about 2% to about 6%) boron, aluminum, or magnesium, 8 parts binder, 90 parts (about 88%) ammonium nitrate, and 2 parts catalyst (Note: all parts, portions and percentages herein are by weight unless otherwise indicated.)

A number of other patents also broadly suggest the use of a wide range of proportions of a finely divided metal in propellants. U.S. Pat. No. 3,423,256 issued to Griffith on Jan. 21, 1969, column 5, lines 51–60, teaches the utility of adding 0.5 to 30%, preferably 0.5 to 25%, of a fuel such as finely divided aluminum to a propellant composition. In Examples 13 and 14 of the reference, a composition containing 5% aluminum in combination with ammonium nitrate, a nitrate ester, and other ingredients is disclosed. U.S. Pat. No. 3,465,675, issued to Bronstein, Jr. on Sept. 9, 1969, teaches an explosive. At column 5, lines 14–33 and Example 3, Bronstein indicates the desirability of adding from 0.5 to 50%, preferably 0.5 to 40%, of a metal fuel such as aluminum or boron. Reissue Patent 25,695, reissued to Cook, et al. on Dec. 8, 1964, teaches an explosive which contains aluminum and ammonium nitrate in a slurry with water. Column 5, lines 30–57, indicates that the compositions can comprise a mixture of 5 to 25% trinitrotoluene (TNT) and 75 to 95% of a mixture of 60 to 100 parts ammonium nitrate and 0 to 40 parts fine aluminum. At column 6, lines 11–13, Cook indicates that boron and magnesium function as well as aluminum, but are more expensive.

The prior art has stated that boron does not increase the burning rate of a propellant under certain circumstances, however. The previously cited Bice patent, in column 10, lines 67–75 and column 11, lines 13–24, states that for a composition containing 82.5% ammonium nitrate, "the addition of boron is actually detrimental to the burning rate and burning rate exponent". Other examples in Bice show that, in the presence of more than 86% ammonium nitrate, the addition of boron increases the burning rate and pressure exponent. (It is desirable, however, to reduce the pressure exponent.)

The previously cited Bice patent illustrates the use of a large proportion of ammonium nitrate (at least 86% by weight) along with minor amounts of a polymeric binder, boron, aluminum, other metals, and other ingredients in a propellant grain. One problem in the art represented by the Bice patent is that propellants which contain more than about 75% ammonium nitrate are difficult and expensive to fabricate into propellant grains. The Bice patent teaches the need to compression mold the propellant at pressures on the order of 3000 to 20,000 psi (about 2100 to about 14,000 Newtons per centimeter squared; abbreviated "N/cm$^2$"). The uncured Bice propellants thus are not pourable slurries, and cannot be simply cast into a motor casing and cured in situ to form a propellant grain. An oversized grain must be formed in a pressure mold and machined to provide a grain of the desired dimensions.

Another continuing problem in the art is how to provide a propellant grain which has a low pressure exponent (ideally zero) when burned at a high pressure. The variation of burning rate with pressure is commonly expressed by a burning rate equation as follows:

$$r=ap^n$$

wherein "r" represents the burning rate, "a" is a variable which depends on the initial grain temperature, and "p" is the pressure in the combustion chamber. The value of "n", the pressure exponent, should be as close as possible to zero over the range of pressures for which the rocket motor is designed. If "n" is uniformly positive, the burn rate will be unstable because a rise in pressure will increase the burn rate, which will in turn increase the pressure. If this positive feedback is substantial, the rocket will over-pressurize and may explode. One problem in the art has been that if a grain having a relatively high operating pressure range is desired, it is difficult to provide a propellant which has a zero pressure exponent.

Ballistic modifiers are propellant ingredients which lower the pressure exponent of a propellant over a certain range of combustion pressures. Ideally, a ballistic modifier would make the pressure exponent zero at all pressures likely to be encountered in the combustion chamber, thus providing a constant burning rate. However, in the real world, a pressure exponent of zero can be approximated only over a fairly narrow range of operating pressures. Typically, above and below the pressure range in which the ballistic modifier operates, the pressure exponent is positive.

Furthermore, the effect of a ballistic modifier in a particular formulation is frequently unpredictable. An ingredient which is an effective ballistic modifier with one binder, or one curing agent, or one distribution of oxidizer particle sizes, or in one proportion, may not be an effective ballistic modifier when one of these parameters is changed. If the characteristic combustion temperature of a propellant is changed substantially, the effect of the ballistic modifier can be changed or even eliminated in some cases. One side effect of excessive use of many ballistic modifiers is to decrease the burning rate of the propellant at all pressures, which is undesirable. Therefore, it is necessary to tailor a particular propellant formulation by trial and error to provide the desired pressure exponent, burning temperature, burning rate, and other properties simultaneously.

OBJECTS OF THE INVENTION

One object of the invention is to provide a propellant which has a reduced pressure exponent over a wide range of pressures, particularly pressures between about 2500 pounds per square inch (psi) and about 7000 psi (between about 1700 and about 4800 N/cm$^2$).

Another object of the invention is a propellant having the reduced pressure exponent defined above which, before curing, is a pourable slurry capable of being cast directly into a rocket motor at low or moderate pressures and cured in situ to provide a finished grain.

Other objects and advantages of the invention will become apparent upon reading the following detailed description and upon reference to the drawings.

SUMMARY OF THE INVENTION

One aspect of the present invention is a cured composite propellant grain consisting essentially of:

A. from about 50% to about 75% by weight of an oxidizer consisting essentially of ammonium nitrate;
B. from about 1% to about 20% of a cured polymeric binder;
C. from 0% to about 30% of a nitrate ester plasticizer;
D. from about 3.5% by weight to about 8% by weight of boron in free elemental form; and
E. from 0% to about 3% aluminum metal.

The propellants within the scope of this invention have surprisingly low pressure exponent values, not exceeding about 0.30, at combustion pressures between about 2500 and about 7000 pounds per square inch (between about 1700 and about 4800 N/cm$^2$). Pressure exponents of about 0.25 have been measured at 7500 psi (5200 N/cm$^2$) for these compositions. These values are particularly low for a propellant burned at a pressure near 7000 psi (4800 N/cm$^2$), and are believed not to have been achieved before in a composition predominantly comprising ammonium nitrate.

A second aspect of the invention is an uncured propellant composition in the form of a pourable slurry. The slurry is curable at ambient pressure to form a solid propellant grain. The slurry consists essentially of the same ingredients recited for the cured composition, except that the binder is uncured.

A third aspect of the invention is a method of making a rocket motor, comprising the steps of:

A. providing a pourable slurry of an uncured propellant having the composition described above;
B. providing a casing having walls defining a propellant cavity;
C. pouring the slurry into the cavity, thereby forming an uncured propellant grain in the cavity conforming to the shape of the walls of the cavity; and
D. curing the uncured grain in situ under conditions which are effective to provide a cured grain having a pressure exponent not exceeding about 0.30 at a combustion pressure between about 2500 and about 7000 pounds per square inch (between about 1700 and about 4800 N/cm$^2$).

DETAILED DESCRIPTION OF THE INVENTION

Figure 1:
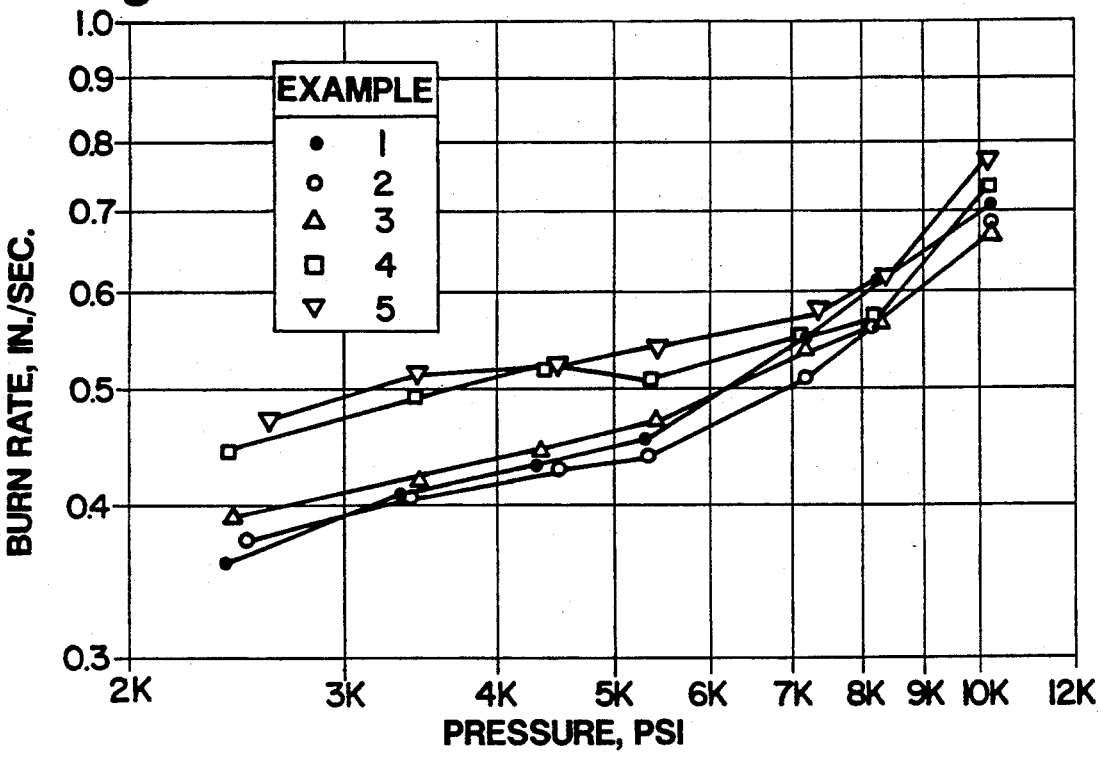
FIG. 1 is a log-log plot of burning rate (y axis) versus combustion pressure (x axis) for propellants containing different proportions of crystalline boron, as given in Examples 1 through 5 below. The slope of the plot is a function of the burning rate exponent; an ideal (zero) pressure exponent would be indicated by a horizontal section of the plot.

While the invention will be described in connection with certain preferred embodiments, it will be understood that I do not intend to limit the invention to those embodiments. On the contrary, I intend to protect all alternatives, modifications, and equivalents as may be included within the spirit and scope of the invention defined by the appended claims.

The uncured propellant composition described above is a pourable slurry which is curable at ambient pressure to form a solid propellant grain. (A "pourable slurry" is one defined herein as a material capable of being poured from a casting funnel at a useful rate and a safe operating temperature, using a reduced pressure of less than about 15 mm Hg. in the motor cavity and a funnel with a spout having an internal cross-section of 4 mm by 20 mm.

One essential ingredient of the composition is from about 50% to about 75% by weight of an oxidizer consisting essentially of ammonium nitrate. The 50% limit provided herein is not contemplated to be critical. The 75% limit provided herein represents the maximum proportion of ammonium nitrate which can be present in a pourable uncured propellant slurry as defined above. If a pourable slurry can be made using a slightly greater proportion of ammonium nitrate without departing from the desired pressure exponent profile defined herein, such a greater proportion of ammonium nitrate is contemplated herein. Preferred proportions of ammonium nitrate are from about 60% to about 75%, more preferably from about 66% to about 71% by weight of the composition.

The particle sizes and size distributions of the ammonium nitrate contemplated herein are those conventional in the propellant formulation art.

Ordinary ammonium nitrate has largely been supplanted in propellant formulations by phase-stabilized ammonium nitrate. Phase-stabilized ammonium nitrate is included within the definition of ammonium nitrate herein. One phase-stabilized ammonium nitrate useful herein is nickel oxide phase-stabilized ammonium nitrate (Hercules, Inc., McGreger, Tex.). Potassium nitrate stabilized ammonium nitrate and PERMALENE stabilized ammonium nitrate are also contemplated herein. (PERMALENE is a trademark of Air Products and Chemicals, Inc., Allentown, Pa.)

The second essential ingredient in the present composition is from about 1% to about 20%, preferably from about 5% to about 10% by weight of the composition, of an uncured polymeric binder. While a variety of polymeric binders have been used for propellant grains, and all are contemplated herein, the preferred binders are those having a high oxygen content. Exemplary binders of this kind include polyglycol adipates.

Polyglycol adipates are polyesters of a polyalkylene glycol whose alkylene moieties each contain from 1 to about 6 carbon atoms, preferably polydiethylene glycol, and an alkanedioic acid having from about 2 to 12 carbon atoms, preferably adipic acid. The polyethylene glycol moieties each have a molecular weight of from 2000 to 3000, preferably about 3000. Polyglycol adipates can be obtained from Mobay Chemical Corporation, Pittsburgh, Pa., or Ruco Polymer Corporation, Hicksville, N.Y. The polyglycol adipates are cured by isocyanates, i.e., DESMODUR N100 or IPDI. DESMODUR N100 is a trifunctional isocyanate (its functionality is about 3.7). Isophorone diisocyanate (IPDI) is a difunctional isocyanate (its functionality is about 2.0) and can be obtained from Huks America, Piscataway, N.J.

An optional ingredient of the propellant composition is from 0% to about 30%, preferably from about 10% to about 25%, more preferably from about 15% to about 20% by weight of the composition, of a nitrate ester plasticizer. Nitrate ester plasticizers decrease the viscosity and increase the energy of propellant compositions. Exemplary nitrate ester plasticizers useful herein are as follows:

| Nitrate Ester Plasticizers | | |
|---|---|---|
| Abbreviation | Name | Also Known As |
| BTTN | 1,2,4, butanetrioltrinitrate | — |
| TMTEN | trimethylolethanetrinitrate | 2-methyl-2-(nitrooxy) methyl-1,3-propanediol dinitrate ester; metriol trinitrate |
| EDGN | ethylene glycol dinitrate | — |
| DEGDN | diethylene glycol dinitrate | — |
| TEGDN | triethylene glycol dinitrate | — |
| PDN | 1,3-propanediol dinitrate | — |
| TMMTN | 2-hydroxymethyl-1,3 propanediol trinitrate | trimethylolmethane-trinitrate |

If nitrate ester plasticizers are used herein, from about 0.5% to about 3%, preferably from about 1% to about 1.5% by weight of the composition, may be a nitrate ester stabilizing agent. This ingredient prevents autocatalytic decomposition of the nitrate ester, thus preventing the formation of gas voids within the grain and adhesion failure between the grain and the casing. Gas voids and adhesion failure can result in catastrophic failure of the grain when ignited.

Stabilizing agents useful herein include N-methyl-4-nitroaniline (MNA), 2-nitrodiphenylamine (2-NDPA), 4-nitrodiphenylamine (4-NDPA), sym-diethyldiphenylurea (ethyl centralite), and diphenylamine. MNA is most commonly used.

An essential component of the present invention is from about 3.5% to about 8% by weight, preferably from about 4% to about 5% by weight, of boron in free elemental form. Elemental boron exists in either of two allotropic forms at room temperature: a crystalline form and an amorphous form. Both are useful herein, but crystalline boron is preferred because it is less reactive with the other propellant ingredients when the grain is stored and while the composition is being mixed. The crystalline boron is ground very fine, preferably to a particle size of about one micron±0.4 microns. One particle size specifically contemplated herein is about 0.7 microns. Larger particles are less preferred because they render the propellant more impact sensitive, lower its burning rate, and provide a higher pressure exponent.

Aluminum has beneficial properties in propellant formulations. However, the present inventor has found that aluminum metal in combination with the other ingredients of the composition (especially when the boron content is minimal) undesirably increases the pressure exponent of the propellant at combustion pressures of 2500 to 7000 psi (about 1700 to 4000 N/cm$^2$). This influence of aluminum is shown in the plots accompanying the working examples.

For this reason, the present compositions should contain no more than about 3% by weight aluminum metal, preferably between 0% and about 1% aluminum metal, and most preferably (from the standpoint of reducing the pressure exponent) are substantially free of aluminum metal. In this context, "substantially free" means that too little aluminum metal is present to materially increase the pressure exponent of the composition at combustion pressures of 2500 to 7000 psi (1700 to 4000 N/cm$^2$).

Other modifying ingredients are also contemplated herein. Burn rate catalysts such as ferric oxide and chromium octoate can be used. Propellant bonding agents such as a propylene imine adduct of isophthalyl chloride are contemplated, for example. Ballistic modifiers can be added to further influence the pressure exponent. Other known propellant ingredients are also useful herein.

A propellant formulated as described above is curable to form a grain having a pressure exponent not exceeding about 0.30, for example a pressure exponent of 0.25, at a combustion pressure between about 2500 and about 7000 psi (between about 1700 and about 4800 N/cm$^2$). Certain compositions will have a pressure exponent as low as about 0.25 at pressures as high as about 7500 psi (about 5200 N/cm$^2$). The examples illustrate this performance. Such a propellant also has a low sensitivity to impact, a high burning rate, and a high combustion efficiency.

EXAMPLES

Propellant compositions having the ingredients and proportions stated in the tables were prepared. In each case, the ingredients other than the curing agent (i.e., DESMODUR N100) and the ammonium nitrate were mixed at 100° F.±5° F. (38° C.±28° C.) for 15 to 25 minutes. Next, ammonium nitrate (AN) was added in four increments, followed by the addition of 0.03 parts by weight of triphenylbismuth (a cure catalyst). The mixture was mixed thoroughly for at least 35 minutes. Then the DESMODUR N100 curing agent was added and mixed for 25 minutes. The end of mix viscosity was then determined. The result was an uncured but curable propellant composition according to one aspect of the present invention.

The propellant was cast into a card gap tube and a G-block, then cured in an oven at 135° F. (57° C.) for 7 days. The card gap tube provided the sample for the card gap test. The G-block samples were cut into strands for some burn rate tests. The burning rate and pressure plots of FIGS. 1 through 6 were generated by determining the burn rates of strands of each propellant at different average pressures. The burning rate of a strand at a particular pressure was evaluated as follows.

A one inch (25.4 mm) by 0.125 inch (3.175 mm) by 0.125 inch (3.175 mm) strand of the propellant was placed in a closed oil bomb along with a hot wire igniter and the bomb was initially pressurized using a hydraulic pump to the desired combustion pressure. The bomb was conditioned to ambient temperature, and the initial pressure at that temperature was recorded. Then the strand was ignited. The pressure in the bomb increased during combustion and reached a maximum final value when combustion was complete. The average of the initial and final pressures was used as the combustion pressure. The interval during which the pressure was changing in the bomb was used as the combustion time of the strand. The length of the strand was divided by the combustion time to determine the burning rate. For each propellant composition, several strands were evaluated at different initial pressures and the average pressure versus burning rate data was plotted. The pressure exponent at a combustion pressure between about 2500 and about 7000 psi (between about 1700 and about 4800 N/cm$^2$) was determined from the burn rate curve for each composition, and is reported in the composition tables. FIGS. 1 to 6 show the results of this experimental work.

Figure 7:
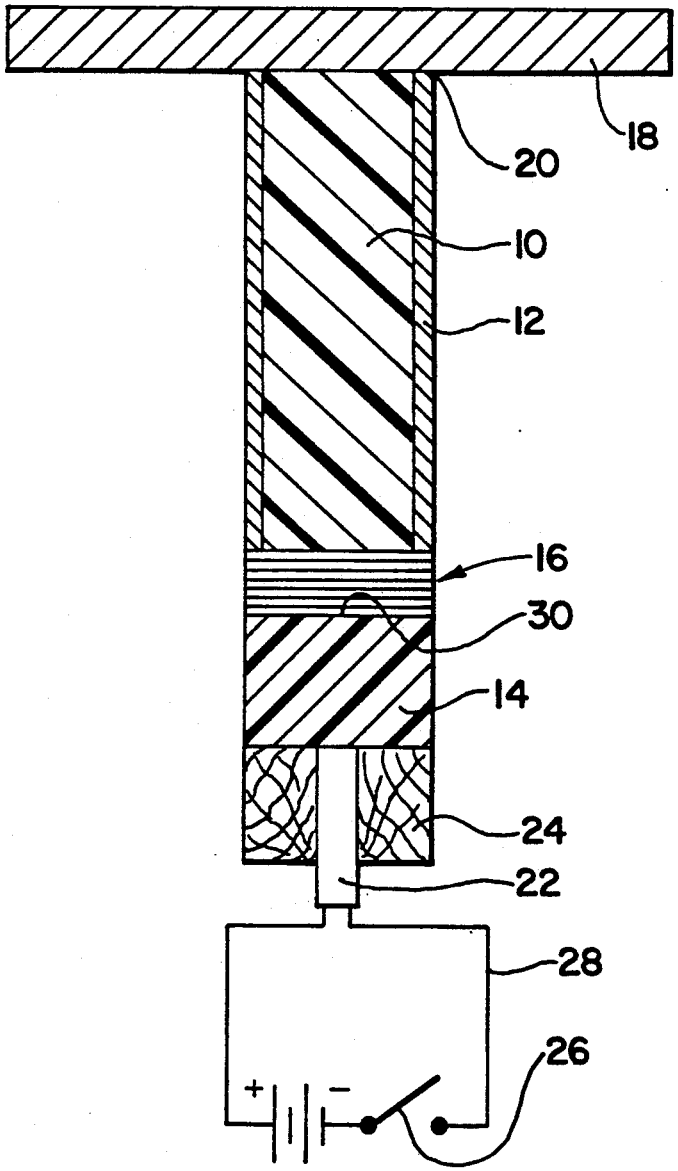
FIG. 7 is a schematic cross-section of apparatus used to carry out the card gap sensitivity test described in the Examples.

The Navy Ordinance Laboratory card gap sensitivity test is performed using the apparatus illustrated in FIG. 7. A charge 10 of the propellant to be evaluated is cast into a cold rolled steel tube 12 which has an inside diameter of 3.65 cm and is 13.97 cm long. An unconfined cylindrical pentolite booster charge 14, which is 5.08 cm in diameter, 5.08 cm long, and weighs 157 grams, is optionally separated from the charge 10 by a stack 16 of cellulose acetate cards, each 0.25 mm thick. (in a "zero cards" test, no cards are present). A mild steel witness plate 18, which is a square plate 15.24 cm on each side and 0.953 cm thick, is supported 1.59 cm above the end 20 of the tube 12. The plate 18 is not fixed to any other structure. A blasting cap 22 is supported in a plug 24 made of wood, and is connected in series with the switch 26 of an electrical circuit 28.

To initiate the test, the switch 26 is closed, detonating the cap 22 and thereby detonating the pentolite booster 14. The pressure at the surface 30 of the booster 14 when it detonates is on the order of 250 kilobars. The impact transmitted from the booster 14 to the charge 10 depends on the number of cards in the stack 16. The more cards present, the less impact is transmitted. The effect of this impact on the charge 10 is determined by examining the plate 18. If a clean cut hole is formed in the plate 18, the charge 10 has been detonated and therefore fails the test. If the plate 18 is not perforated, the charge 10 has not detonated and passes the test. In examples, 9 and 10 below, a single shot was conducted for each mix, using zero cards. If the charge 10 did not detonate, it was identified as a rugged, nondetonable propellant.

FIG. 1 shows a family of curves representing a series of compositions according to Examples 1–5 in which the proportion of boron was steadily increased (and replaced a slight amount of the total ammonium nitrate), while the proportions of aluminum (1% by weight) and all other ingredients remained the same. In these examples, the compositions containing 2–4% by weight boron provided a lower burning rate and a higher pressure exponent in the region between about 2500 and about 7000 psi (about 1700 to about 4800 N/cm$^2$) than the compositions containing 5 to 6% by weight boron. Thus, the pressure exponents and burning rates at boron levels exceeding 4% by weight were significantly improved. A plateau (substantially zero) pressure exponent between 3500 to 4500 psi was observed for a 6% boron formulation.

Figure 2:
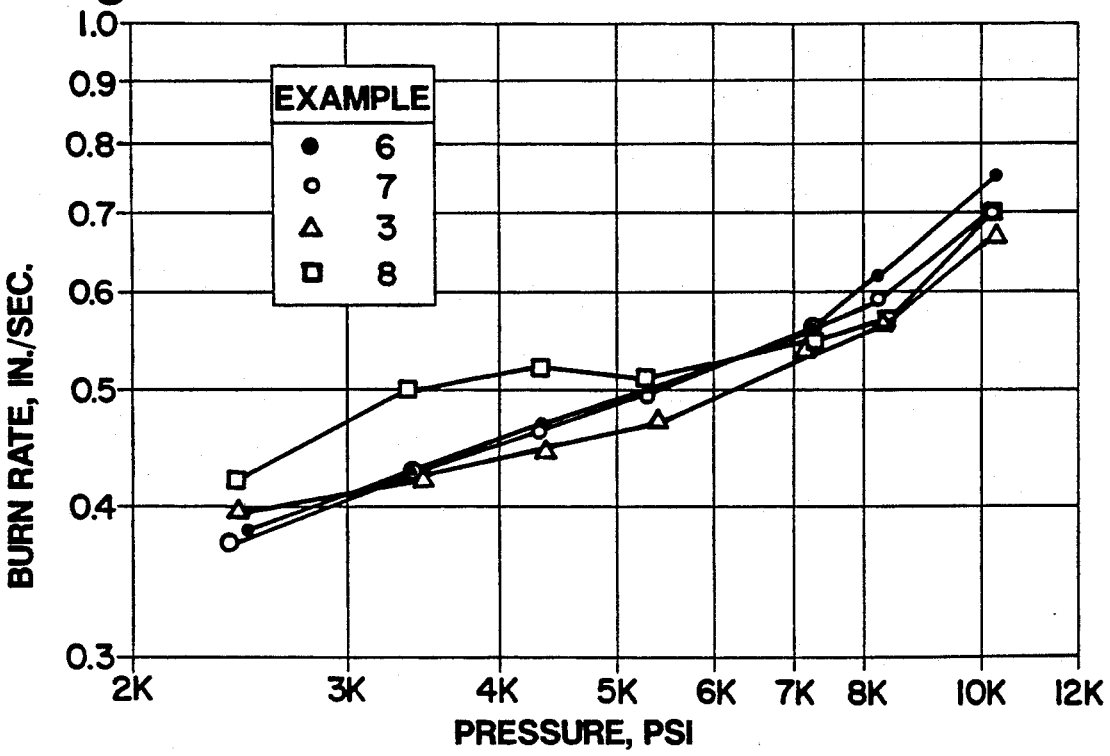
FIG. 2 is a plot like FIG. 1 for propellants containing boron and different proportions of aluminum, as given in Examples 3 and 6 through 8 below.

The data in FIG. 2 represents a series of compositions (Examples 3, 6, 7, and 8) in which the proportion of aluminum was progressively increased (and replaced a slight amount of the total ammonium nitrate), while the proportions of boron (4% by weight) and all other ingredients remained the same. In these examples, the compositions containing from 1% to about 3% by weight aluminum provided a lower burning rate and a higher pressure exponent below about 7000 psi (about 4800 N/cm$^2$) than the composition which was free of aluminum. The pressure exponents of these formulations are listed in Tables 1 and 2. FIG. 2 thus shows that as little as 1% aluminum in the present compositions has a deleterious effect on the pressure exponent and burning rate.

Figure 3:
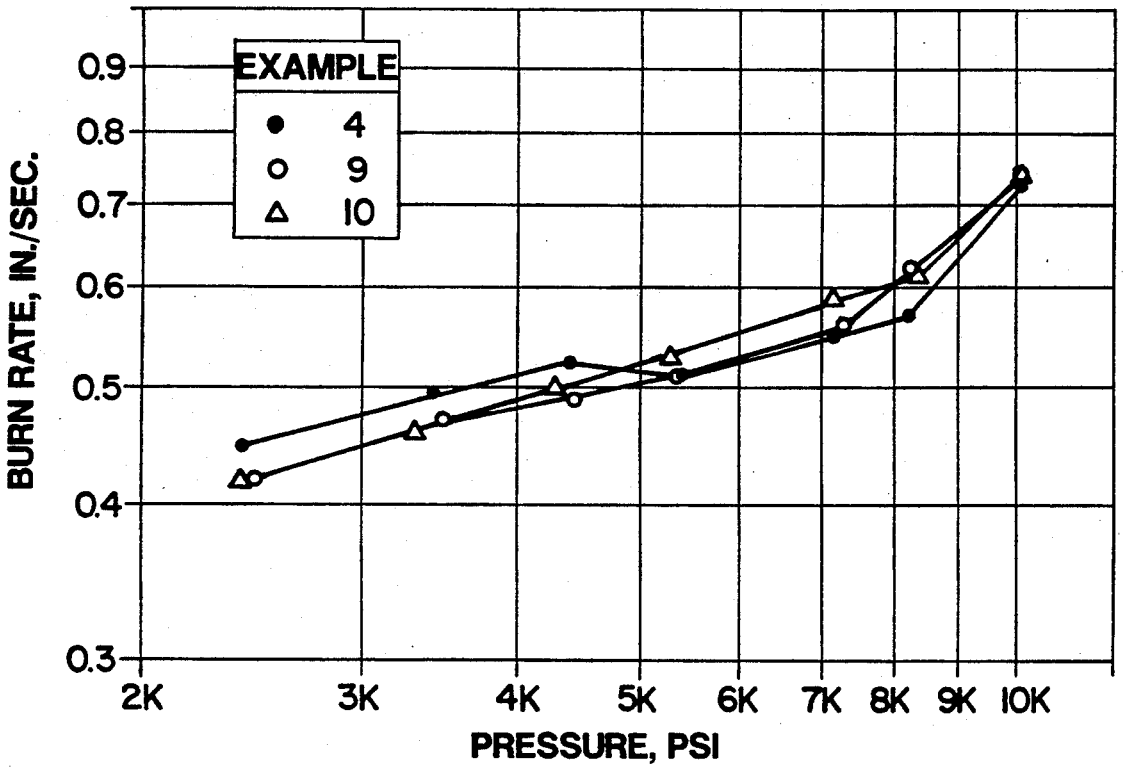
FIG. 3 is a plot like FIG. 2 for propellants formulated as described in Examples 4, 9, and 10 below.

FIG. 3, representing work with examples 4, 9, and 10, is similar to FIG. 2, except that the proportion of boron is increased to 5% by weight and there is no data for 0% aluminum. FIG. 3 shows an improvement in the pressure exponent at 1% aluminum, versus 2% or 3% aluminum. The pressure exponents of these formulations are listed in Tables 1 and 2. FIGS. 2 and 3 show that the benefits of the invention can be achieved at a higher aluminum level if the boron level is increased.

Figure 4:
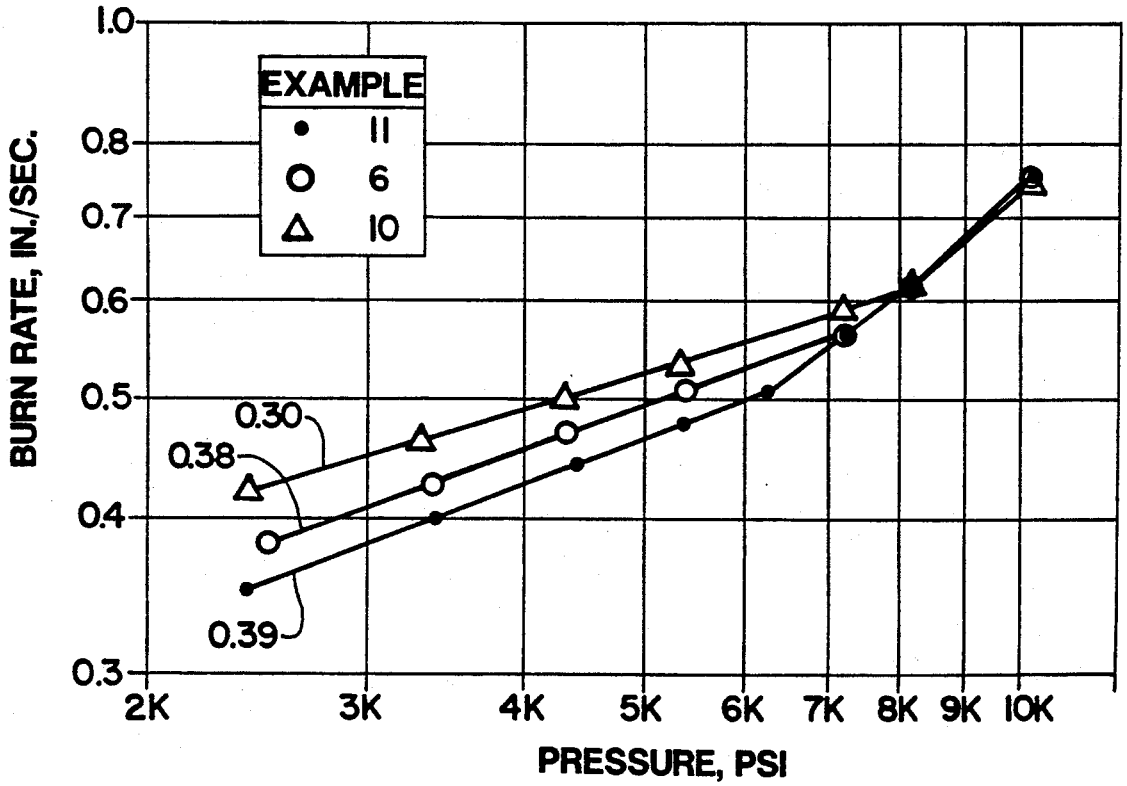
FIG. 4 is a plot like FIG. 1 for propellants formulated as described in Examples 6, 10, and 11 below.

FIG. 4 is similar to FIG. 1, except that the compositions (Examples 6, 10, and 11) each contained 3% aluminum, and the proportion of boron was varied. The pressure exponent steadily decreased, and thus improved, as more boron was added. Only at 5% boron was the pressure exponent about 0.30, and thus within the scope of the invention. FIG. 4 thus shows that the benefits of the invention can be achieved with 3% aluminum present if 5% boron is also present.

Figure 5:
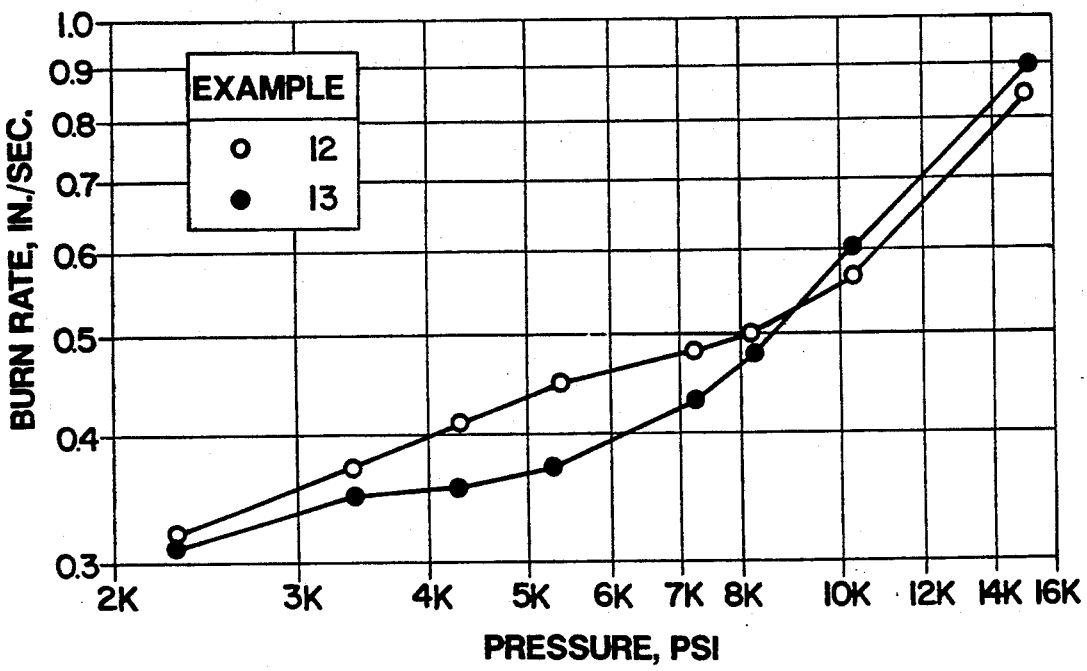
FIG. 5 is a plot like FIG. 1, comparing the formulation of Example 12, containing powdered aluminum and nickel oxide phase-stabilized ammonium nitrate, to that of Example 13, containing the same oxidizer and flaked aluminum.
Figure 6:
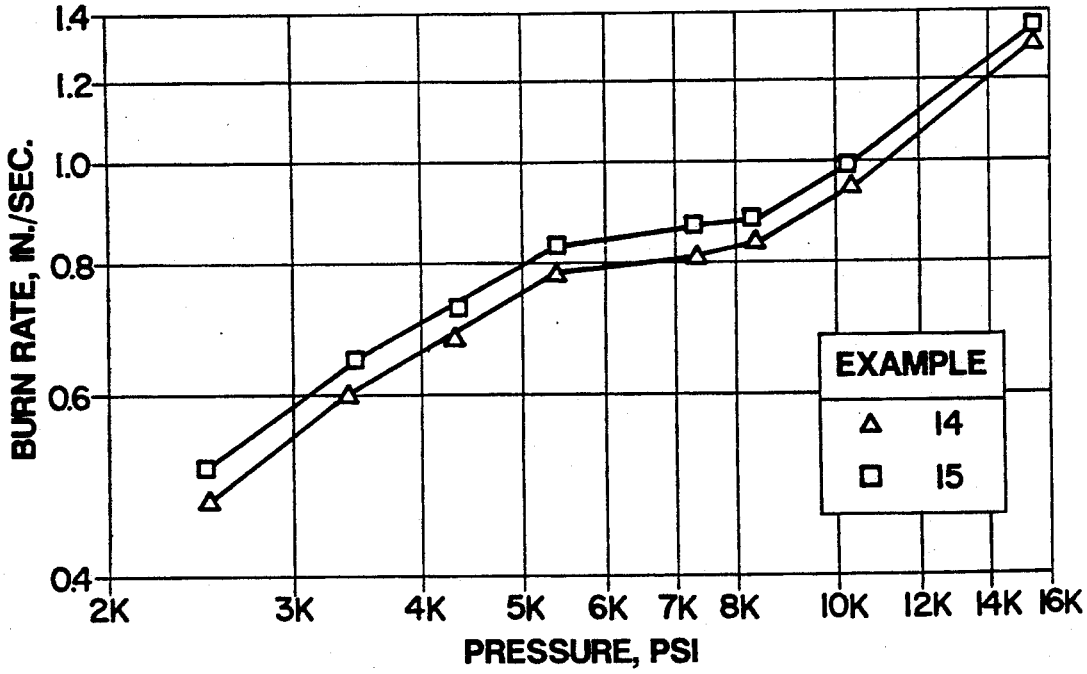
FIG. 6 is a plot making a comparison like that of FIG. 5 for Examples 14 and 15, wherein the oxidizer is PERMALENE stabilized ammonium nitrate. (PERMALENE is a trademark of Air Products and Chemicals, Inc., Allentown, Pa.)

FIGS. 5 and 6 (Examples 12–15) show equal proportions of all ingredients, and compare the performance of flaked aluminum to powdered aluminum. In FIG. 5, using nickel oxide phase-stabilized ammonium nitrate as the oxidizer, the burning rate was lower up to about 8500 psi (5900 N/cm$^2$), but the pressure exponent was somewhat lower at pressures of about 3500 to 5500 psi (about 2400 to 3800 N/cm$^2$), using flaked aluminum. Thus, flaked aluminum is preferred at moderate combustion pressures FIG. 6 shows a uniform increase in the burning rate using flaked aluminum and PERMALENE ammonium nitrate, but does not show an improved pressure exponent when flaked aluminum is used with this oxidizer.

Table 4 sets forth additional properties of two typical low pressure exponent boron propellant formulations (Examples 9 and 10). As shown in Table 4, a theoretical specific impulse (Isp) of about 240 lbf sec/lbm (2354.5 N sec/kg. for a zero card (rugged, nondetonable) low pressure exponent propellant formulation has been achieved by incorporating 5% boron and 2% or 3% aluminum in a nickel oxide phase stabilized ammonium nitrate propellant.

TABLE 1

| Example | 1 | 2 | 3 | 4 | 5 |
|---|---|---|---|---|---|
| Composition | 1918 | 1927 | 1936 | 1990 | 2020 |
| Ingredient (wt. %) | | | | | |
| Ammonium Nitrate[1] | 71 | 70 | 69 | 68 | 67 |

TABLE 1-continued

| Example | 1 | 2 | 3 | 4 | 5 |
|---|---|---|---|---|---|
| Binder[2] | 6.5 | 6.5 | 6.5 | 6.5 | 6.5 |
| Plasticizer[3] | 19 | 19 | 19 | 19 | 19 |
| Boron[4] | 2 | 3 | 4 | 5 | 6 |
| Aluminum[5] | 1 | 1 | 1 | 1 | 1 |
| MNA | 0.5 | 0.5 | 0.5 | 0.5 | 0.5 |
| Total Wt. | 100 | 100 | 100 | 100 | 100 |
| Pressure Exponent | 0.25[7] | 0.2[6] | 0.24[6] | negative[7] | 9.2[8] |

[1]Nickel oxide phase-stabilized ammonium nitrate.
Footnotes 2-5 follow Table 3.
[6]measured over the range between 2500 and 7000 psi (about 1700 to about 3600 N/cm$^2$).
[7]measured over the rage between 4000 and 5500 psi (2740 to 3770 N/cm$^2$)
[8]measured over the rage between 3500 and 5500 psi (2400 to 3790 N/cm$^2$)

TABLE 2

| Example | 6 | 7 | 8 | 9 | 10 |
|---|---|---|---|---|---|
| Composition | 1971 | 1951 | 1989 | 1961 | 1992 |
| Ingredient (wt. %) | | | | | |
| Ammonium Nitrate[1] | 67 | 68 | 70 | 67 | 66 |
| Binder[2] | 6.5 | 6.5 | 6.5 | 6.5 | 6.5 |
| Plasticizer[3] | 19 | 19 | 19 | 19 | 19 |
| Boron[4] | 4 | 4 | 4 | 5 | 5 |
| Aluminum[5] | 3 | 2 | 0 | 2 | 3 |
| MNA | 0.5 | 0.5 | 0.5 | 0.5 | 0.5 |
| Total Wt. | 100 | 100 | 100 | 100 | 100 |
| Pressure Exponent | 0.38[6] | 0.37[6] | negative[7] | 0.23[6] | 0.30[6] |

[1]Nickel oxide phase-stabilized ammonium nitrate.
Footnotes 2-5 follow Table 3.
[6]measured over the range between 2500 and 7000 psi (about 1700 to about 3600 N/cm$^2$)
[7]measured over the range between 4000 and 5000 psi (2740 to 3430 (N/cm$^2$)

TABLE 3

| Example | 11 | 12 | 13 | 14 | 15 |
|---|---|---|---|---|---|
| Composition | 1966 | 1801 | 1867 | 1822 | 1858 |
| Ingredient (wt. %) | | | | | |
| Ammonium Nitrate | | | | | |
| PERMALENE stabilized | — | — | — | 73 | 73 |
| Nickel oxide stabilized | 68 | 67 | 67 | — | — |
| Binder[2] | 6.5 | 7.5 | 7.5 | 6.0 | 6.0 |
| Plasticizer[3] | 19 | 22 | 22 | 17.5 | 17.5 |
| Boron[4] | 3 | 2 | 2 | 2 | 2 |
| Aluminum | | | | | |
| flaked | 3 | — | 1 | — | 1 |
| powdered | — | 1 | — | 1 | — |
| MNA | 0.5 | 0.5 | 0.5 | 0.5 | 0.5 |
| Total Wt. | 100 | 100 | 100 | 100 | 100 |
| Pressure Exponent | 0.30[6] | 0.4[6] | about 0[7] | <0.1[8] | <0.1[8] |

[2]Binder consisted of 86.5 parts by weight polyglycol adipate (Mobay), 8.6 parts by weight DESMODUR N100 curing agent, and 4.9 parts by weight IPDI.
[3]Plasticizer is 42 parts by weight TEGDN and 58 parts by weight TMETN.
[4]Crystalline form, ground to about 0.7 microns
[5]unless otherwise indicated, aluminum is in flaked form
[6]measured over the range between 2500 and 7000 psi (about 1700 to 3600 N/cm$^2$)
[7]measured over the range between 3500 and 5000 psi (2400 to 3430 N/cm$^2$)
[8]measured over the range between 5000 and 7500 psi (3430 to 5140 N/cm$^2$)

TABLE 4

| Ingredient (wt. %) | Composition 1 | Composition 2 |
|---|---|---|
| Theoretical Isp, lb.sec/lb | 239.6 | 240.9 |
| Density, g/cc | 1.6522 | 1.6577 |
| Card Gap Test at 0-card | Negative | Negative |
| Burn Rate at 3500 in/sec | 0.47 | 0.47 |
| Pressure Exponent[5] | 0.23 | 0.30 |

[1]Measured over the range between 2500 and 7000 psi (about 1700-3600 N/cm$^2$).

I claim:

1. A cured composite propellant grain consisting essentially of:

A. from about 50% to about 75% by weight of an oxidizer consisting essentially of ammonium nitrate;

B. from about 1% to about 20% by weight of a cured polymeric binder;

C. from 0% to about 30% by weight of a nitrate ester plasticizer;

D. from about 3.5% by weight to about 8% by weight of boron in free elemental form; and E. from 0% to about 3% by weight aluminum metal; said propellant having a pressure exponent not exceeding about 0.30 at a combustion pressure between about 2500 and about 7000 pounds per square inch (between about 1700 and about 4800 N/cm$^2$).

2. The grain of claim 1, consisting essentially of from about 60% to about 75% by weight of said oxidizer.

3. The grain of claim 1, consisting essentially of from about 66% to about 71% by weight of said oxidizer.

4. The grain of claim 1, wherein said ammonium nitrate is phase-stabilized ammonium nitrate.

5. The grain of claim 1, wherein said ammonium nitrate is nickel oxide phase-stabilized ammonium nitrate.

6. The grain of claim 1, wherein said binder is a polyglycol adipate.

7. The grain of claim 1, consisting essentially of from about 5% to about 10% by weight of said binder.

8. The grain of claim 1, wherein said nitrate ester plasticizer is selected from the group consisting of triethylene glycol dinitrate, trimethylolethane trinitrate, and mixtures thereof.

9. The grain of claim 1, consisting essentially of from about 10% to about 25% by weight of said plasticizer.

10. The grain of claim 1, consisting essentially of from about 15% to about 20% by weight of said plasticizer.

11. The grain of claim 1, consisting essentially of from about 4% to about 5% by weight elemental boron.

12. The grain of claim 1, wherein said elemental boron has a particle size of about one micron.

13. The grain of claim 1, wherein said boron consists essentially of crystalline elemental boron.

14. The grain of claim 1, wherein substantially all said aluminum metal is flaked aluminum.

15. The grain of claim 1, wherein said propellant contains between 0% and about 1% by weight aluminum metal.

16. The grain of claim 1, wherein said propellant is substantially free of aluminum metal.

17. An uncured propellant composition in the form of a pourable slurry which is curable at ambient pressure to form a solid propellant grain, said slurry consisting essentially of:

A. from about 50% to about 75% by weight of an oxidizer consisting essentially of ammonium nitrate;

B. from about 1% to about 20% by weight of an uncured polymeric binder;

C. from 0% to about 30% by weight of a nitrate ester plasticizer;

D. from about 3.5% to about 8% by weight of boron in free elemental form; and

E. from 0% to about 3% by weight of aluminum metal;

said propellant being curable to form a grain having a pressure exponent not exceeding about 0.30 at a combustion pressure between about 2500 and about 7000 pounds per square inch (between about 1700 and about 4800 N/cm$^2$).

18. A method of making a rocket motor, comprising the steps of:

A. providing a pourable slurry of uncured propellant having the composition of claim 17;

B. providing a casing having walls defining a propellant cavity;

C. pouring said slurry into said cavity, thereby forming an uncured propellant grain in said cavity conforming to the shape of said walls; and D. curing said uncured grain in situ under conditions effective to provide a cured grain having a specific impulse not exceeding about 0.30 at a combustion pressure between about 2500 and about 7000 pounds per square inch (between about 1700 and about 4800 N/cm$^2$).

* * * * *